US006019055A

United States Patent [19]

Likitcheva

[11] Patent Number: 6,019,055

[45] **Date of Patent: *Feb. 1, 2000**

[54] METHOD AND APPARATUS FOR IMPROVING THE LOAD-BEARING CAPACITY OF FLOATING STRUCTURES

[76] Inventor: Pichit Likitcheva, 28/1 Soi Chuasuwan, Udomsuk Praves, Bangkok 10260, Thailand

[ * ] Notice: This patent issued on a continued prosecution application filed under 37 CFR 1.53(d), and is subject to the twenty year patent term provisions of 35 U.S.C. 154(a)(2).

[21] Appl. No.: 08/840,148

[22] Filed: Apr. 11, 1997

[30] Foreign Application Priority Data

May 17, 1996 [GB] United Kingdom ..... 9610351

[51] Int. Cl.[7] ..... B63B 1/00

[52] U.S. Cl. ..... 114/61.1; 114/266

[58] Field of Search ..... 114/61, 121, 122, 114/123, 261, 262, 263, 264, 258, 265, 266

[56] References Cited

U.S. PATENT DOCUMENTS

| | | | |
|---|---|---|---|
| 2,952,234 | 9/1960 | Levinson | 114/266 |
| 4,936,030 | 6/1990 | Rennex . | |
| 5,588,387 | 12/1996 | Tellington | 114/261 |

FOREIGN PATENT DOCUMENTS

| | | | |
|---|---|---|---|
| 0062622A1 | 10/1982 | European Pat. Off. . | |
| 2647034 | 4/1978 | Germany | 114/61 |
| 813259 | 5/1959 | United Kingdom . | |
| 873762 | 7/1961 | United Kingdom . | |
| 2073006 | 10/1981 | United Kingdom . | |

*Primary Examiner*—Stephen Avila
*Attorney, Agent, or Firm*—Hall, Priddy & Myers

[57] ABSTRACT

Floating structures are made to carry load up to their design loading capacities without the risk of being capsized or damaged, wherein the improvement comprises the method and apparatus for diverting all or part of the initial load to other area(s) of the structure by means of a hydraulic and/or spring action between two or more floating or resilient means that were installed under the structure.

12 Claims, 5 Drawing Sheets

METHOD AND APPARATUS FOR IMPROVING THE LOAD-BEARING CAPACITY OF FLOATING STRUCTURES

BACKGROUND OF THE INVENTION

This invention relates to a method and apparatus for the improvement in load-bearing capacity of floating structures. More particularly, it relates to a method of and an apparatus for increasing the load on floating structures such as pontoon, vehicle shock-absorbing system, airplane landing gear, shoe heels, buildings, and the likes without being toppled over.

Under a normal usage of a typical pontoon there is always a chance of the pontoon being overly tilted or even capsized as a result of an imbalanced loading. This type of accidents could happen even with a load of less than the design capacity of the pontoon.

In the case of vehicle shock-absorbing system, airplane landing gear, shoe heels, or buildings situated on an unstable ground, a sudden load concentrating on any particular point could lead to early structural failures of the entire system.

To minimize such incident several methods such as by physically queueing of the people using the pontoon into columns in order to distribute the load has been used. But this type of restraint remains unpopular among the commuters due to the unresolved problem concerning the interaction between those who want to get off and those who want to get on the boat at the same time.

Another method is by making the pontoon more stable in the horizontal direction, i.e. by installing columns around the pontoon to prevent it from tilting. However, this type of permanent structures require large amount of investment.

As for buildings and other structures situated on an unstable ground such as those in the earthquake area several methods have been used in order to lessen the impact due to the sudden movement of the ground. However, they are not very reliable and still need to be improved.

SUMMARY OF THE INVENTION

It is therefore an objective of the present invention to provide a method and apparatus to improve the load-bearing capacity of floating structures by making them more stable without compensating their design capacities.

According to the present invention, there is provided a method and apparatus to improve the load-bearing capacity of floating structures such as pontoon, vehicle shock-absorbing system, aircraft landing gears, shoe heels, buildings, and the likes, by diverting all or part of the initial load at any given points on the structure to other location(s) in accordance with the hydraulic action between two or more floating or resilient means installed under the structure. Under such action of load diversion it is therefore possible to increase the load onto the same general area of the structure without the risk of putting the entire structure under a hazardous condition before the design capacity of the structure has been reached. Specifically, the present invention consists of a number of large and small (major and minor, respectively) floating or resilient means that operate in tandem. Each set of large and small floating or resilient means installed under the structure is completed with interlinking hydraulic system that will allow the minor floating or resilient means to take on the initial load, even when such load was not directly on the minor floating or resilient means itself. And after the minor floating or resilient means loading capacity have been reached then the remaining or any additional load will be born by the major floating or resilient means.

DETAILED DESCRIPTION OF THE PREFERRED EMBODIMENTS

Figure 1:
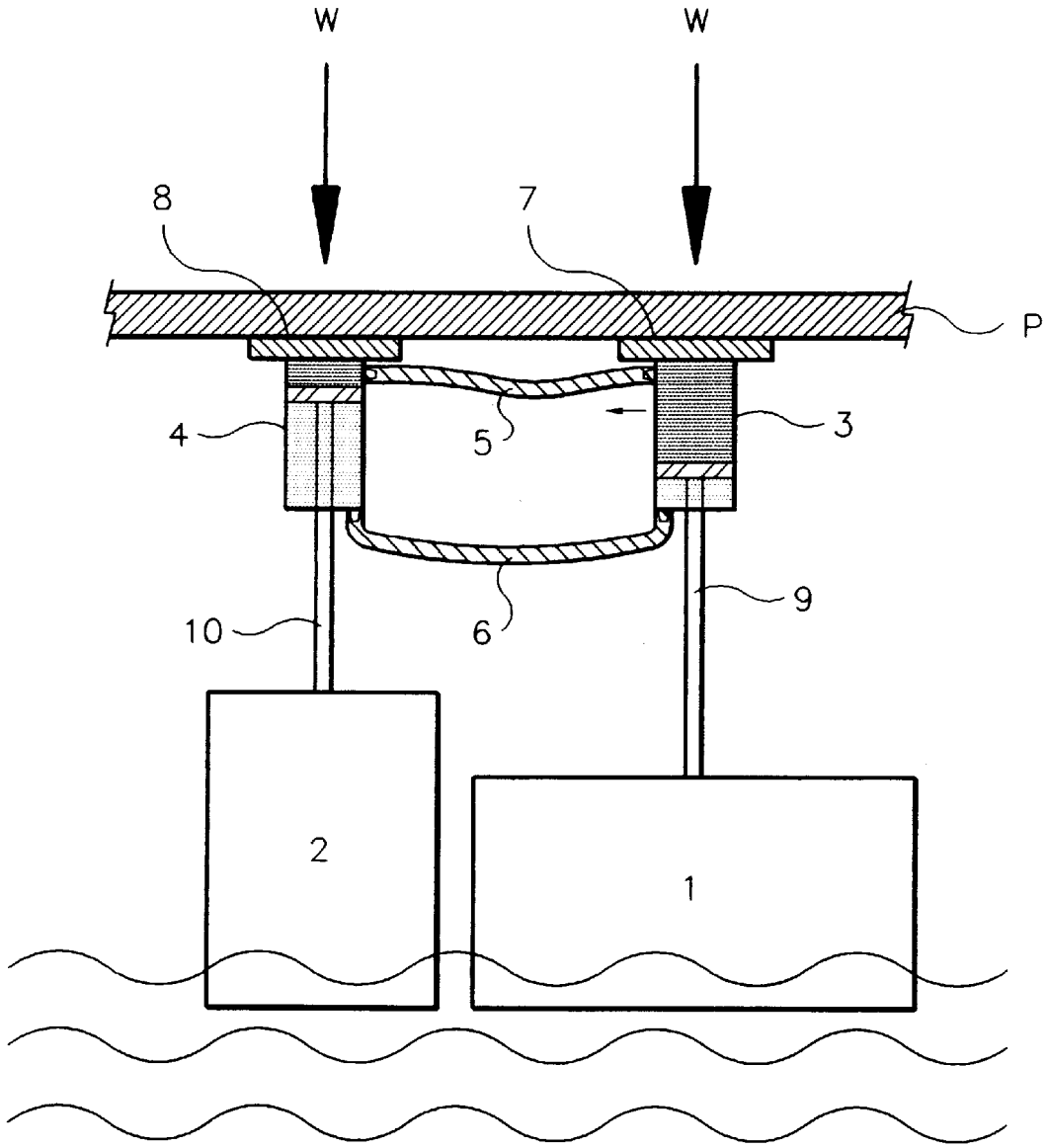
FIG. 1 is a schematic cross-sectional view showing a load-bearing apparatus according to one embodiment of the present invention.

Referring to the drawings, the illustrative embodiments of load-bearing apparatus and the method of operation according to the present invention will be explained in detail.

FIG. 1 shows one set of the load-bearing apparatus for a loading platform P of a typical pontoon with a design loading capacity W. The apparatus according to the present invention consists of a major pontoon 1 and one or more minor pontoons 2, wherein the buoyancy capacity of the major pontoon 1 is greater than that of the minor pontoons 2. Pontoons 1, 2 are connected to the underside of the platform P at locations 7 and 8, respectively, via piston rods 9, 10 of hydraulic cylinders and pistons 3 and 4, respectively, of the same operating pressure. Hydraulic cylinders 3 and 4 are linked to each other by hydraulic pipes 5, 6 wherein the hydraulic fluid from cylinder 3 flows into cylinder 4 via pipe 5 and the hydraulic fluid from cylinder 4 to cylinder 3 via pipe 6.

Under a normal operating condition when a load W is applied on the platform P at location 7 both pontoons 1, 2 will be forced to submerge to the predetermined levels in accordance with their respective buoyancies. However, if the load at location 7 on platform P is higher than the design loading capacity W the major pontoon 1 will also bear more load which will create a counter force of the same intensity due to its buoyancy, and therefore will put a pressure through the piston rod 9 of cylinder 3 and force the hydraulic fluid from cylinder 3 into cylinder 4 via pipe 5. The hydraulic fluid coming from cylinder 3 will in turn push down the piston rod 10 of the cylinder 4 of the minor pontoon 2, and therefore submerge the minor pontoon 2 further down to the next level which is in addition to any existing load W at location 8 above the minor pontoon 2. It is to be noted that the additional load-bearing capacity of the minor pontoon 2 can be predetermined by the length of piston rods 9, 10 in relation to the cross-sectional areas of pontoon 1,2, respectively.

After the minor pontoon 2 has been forced down to the maximum length of the piston rod 10 any remaining or additional load at location 7 will be born by the major pontoon 1 until the design capacity has been reached.

It can be seen that, with an apparatus according to the present invention, the concentrated load will be distributed to other areas without putting the entire platform under a risk of being tilted or capsized.

Figure 2:
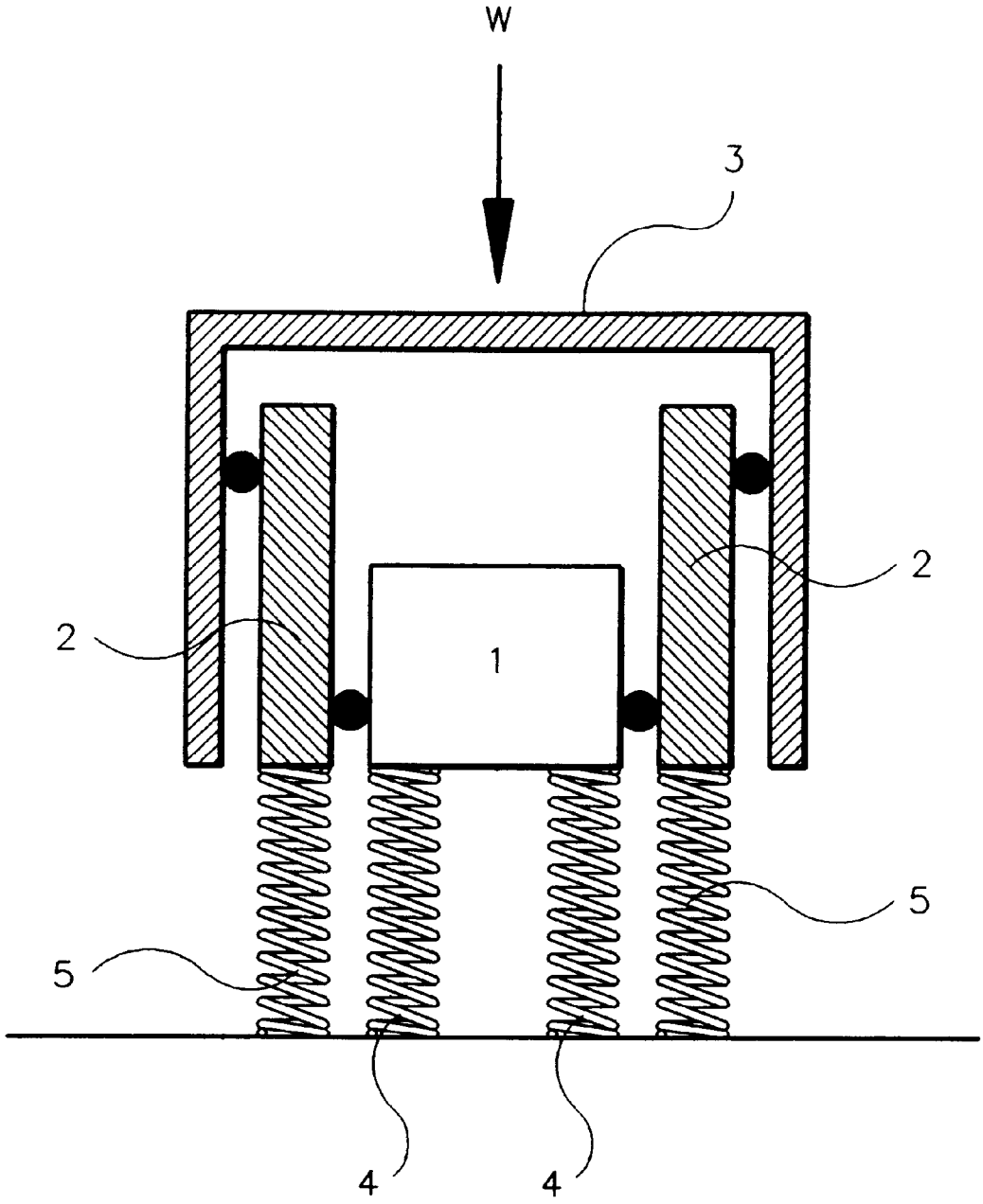
FIG. 2 is a schematic cross-sectional view showing a load-bearing apparatus according to another embodiment of the present invention.

FIG. 2 shows another embodiment of the present invention, wherein the hydraulic piston cylinders of the apparatus are concentrically arranged in an enclosure. As shown in the drawing, piston 1 and piston 2 are concentrically arranged to be able to move in a vertical direction within an enclosure 3. Piston 1 is supported by a coil spring 4 of higher loading capacity whereas piston 2 is supported by a coil spring 5 of lower loading capacity. When an initial load W is applied to the top of an enclosure 3 both springs 4, 5 will, theoretically, share the load evenly. However, since the spring 4 is stronger than spring 5 it will therefore force the piston 1 to move up and this action will in turn force the hydraulic fluid of the piston 1 to flow into the piston cylinder 2 and therefore forcing down on the coil spring 5 through the movement of piston 2. From such action the initial load W will be diverted to spring 5 instead of being concentrated on spring 4, and leave the spring 4 to take on any additional load at a later stage.

Figure 3:
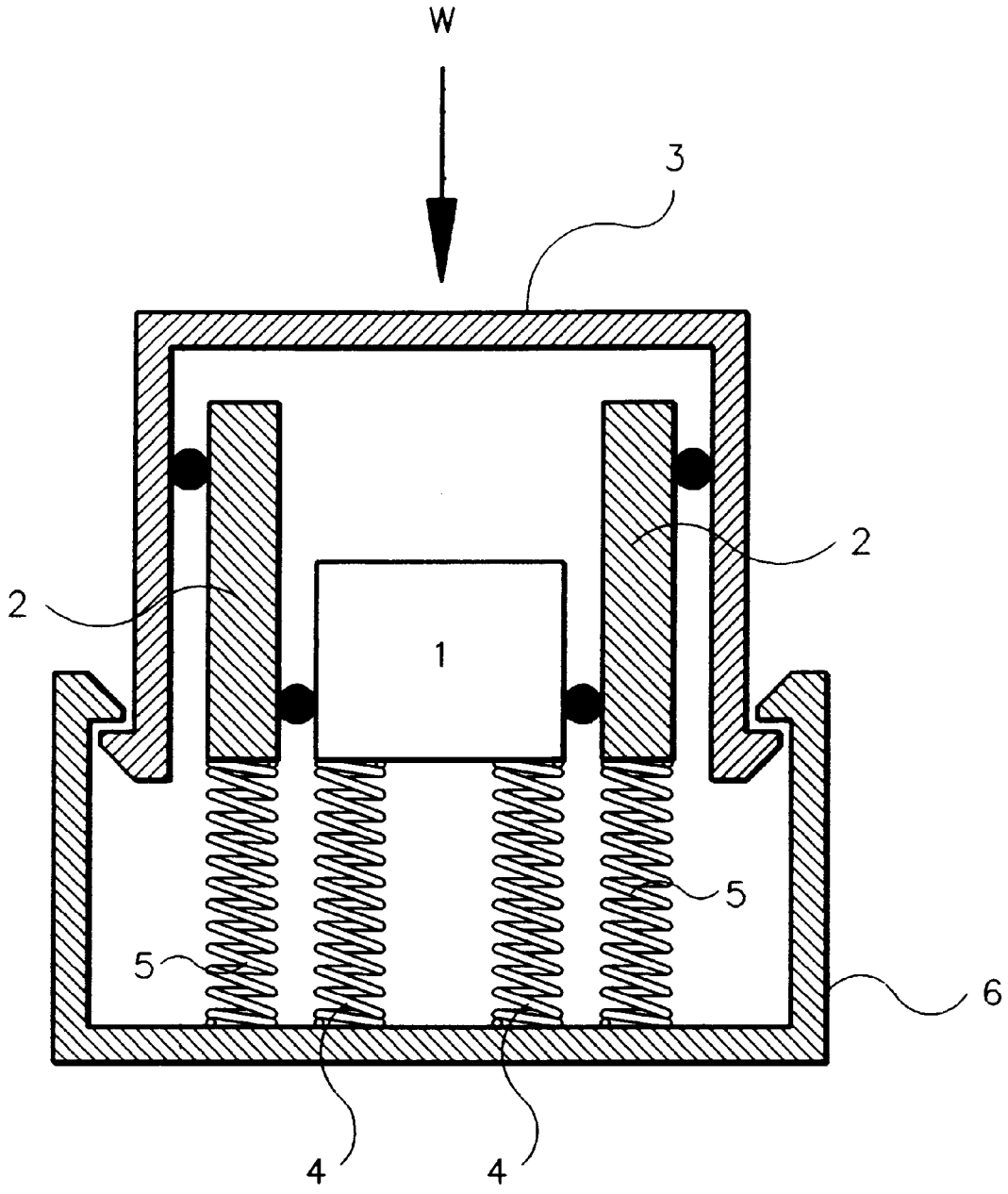
FIG. 3 is a schematic cross-sectional view showing a variation of the apparatus shown in FIG. 2.

FIG. 3 is a variation of the load-bearing apparatus shown in FIG. 2 wherein a bottom enclosure 6 is provided for the reason of mobility.

Figure 4:
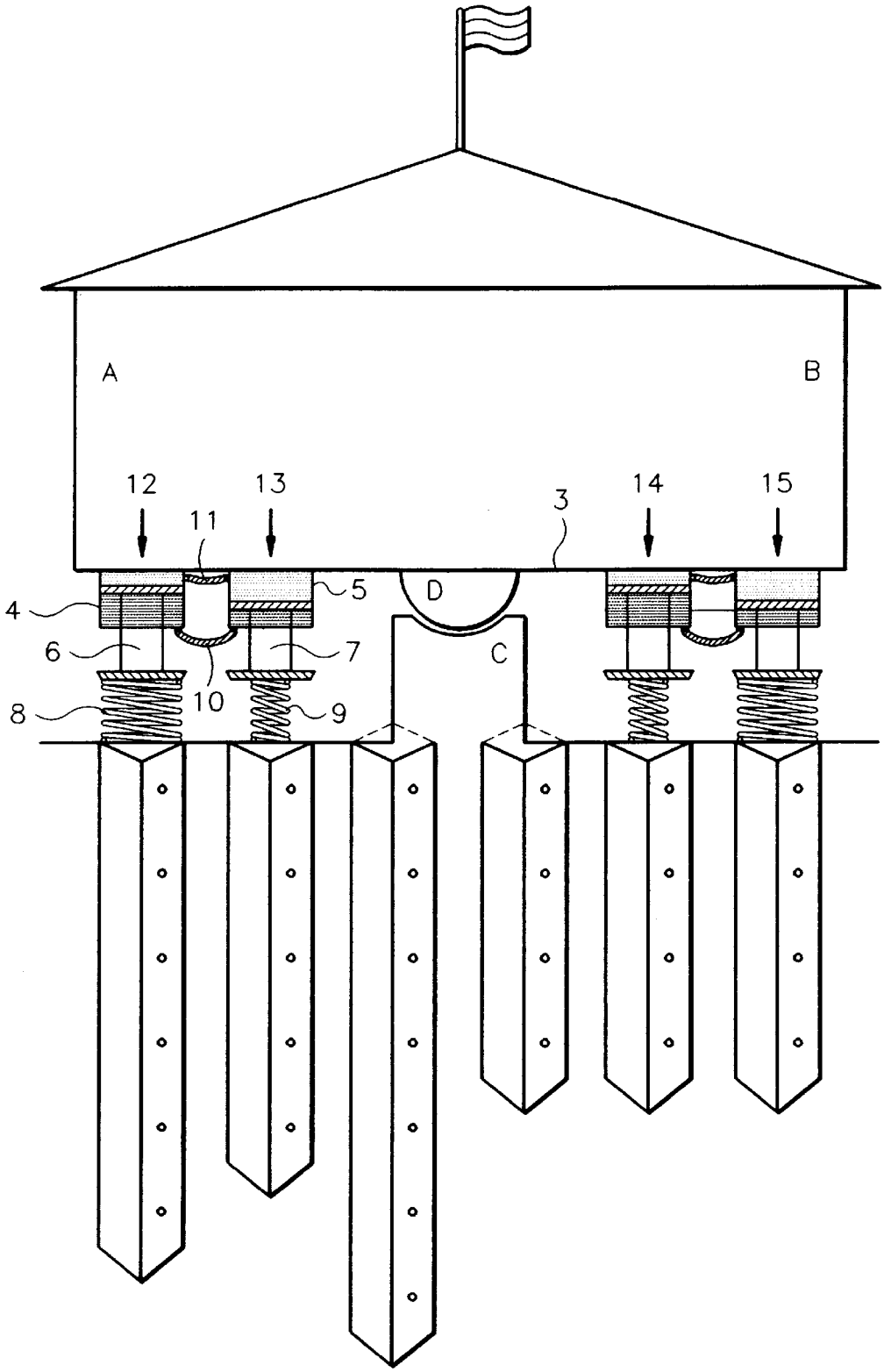
FIG. 4 is a schematic cross-sectional view showing load-bearing apparatus according to another embodiment of the present invention that works in conjunction with a fulcrum.

FIG. 4 is a schematic cross-sectional view of the load-bearing apparatus according to another embodiment of the present invention that were installed under a building on an unstable ground such as those found in the earthquake areas. According to the drawing the entire weight of a building is being born by the main foundation C at location D that acts as a balancing fulcrum of the building floor 3. Hydraulic cylinders 4 and 5 of the same capacity with respective piston rods 6, 7 of the same length were installed in tandem under the building floor 3. The lower end of piston rod 6 is connected to a lower compression capacity coil spring 8 that sits on top of a piling, whereas the lower end of piston rod 7 is connected to a higher compression capacity coil spring 9 on another piling of the foundation. Hydraulic cylinders 4, 5 are respectively interconnected by hydraulic pipes 10, 11.

Upon the movement of the ground under the building due the force of the earthquake the entire building will be subject to a sudden movement both in the vertical and horizontal directions, and will put the different parts of the building under the stress and strain. The building floor 3 at side A and side B will be moved in an opposite direction at locations 12, 13 and locations 14, 15 respectively due to the fulcrum action at location D. When the load is applied to locations 12, 13 the hydraulic cylinders 4, 5 will receive the load at the same time. However, since the coil spring 9 has a higher compression capacity it is therefore able to force the piston rod 7 to move up, and concurrently forcing the hydraulic fluid in the cylinder 5 through pipe 11 into the cylinder 4. With such action the piston rod 6 is then forcing down on the spring 8 and consequently diverting the load to location 12 from location 13.

Figure 5:
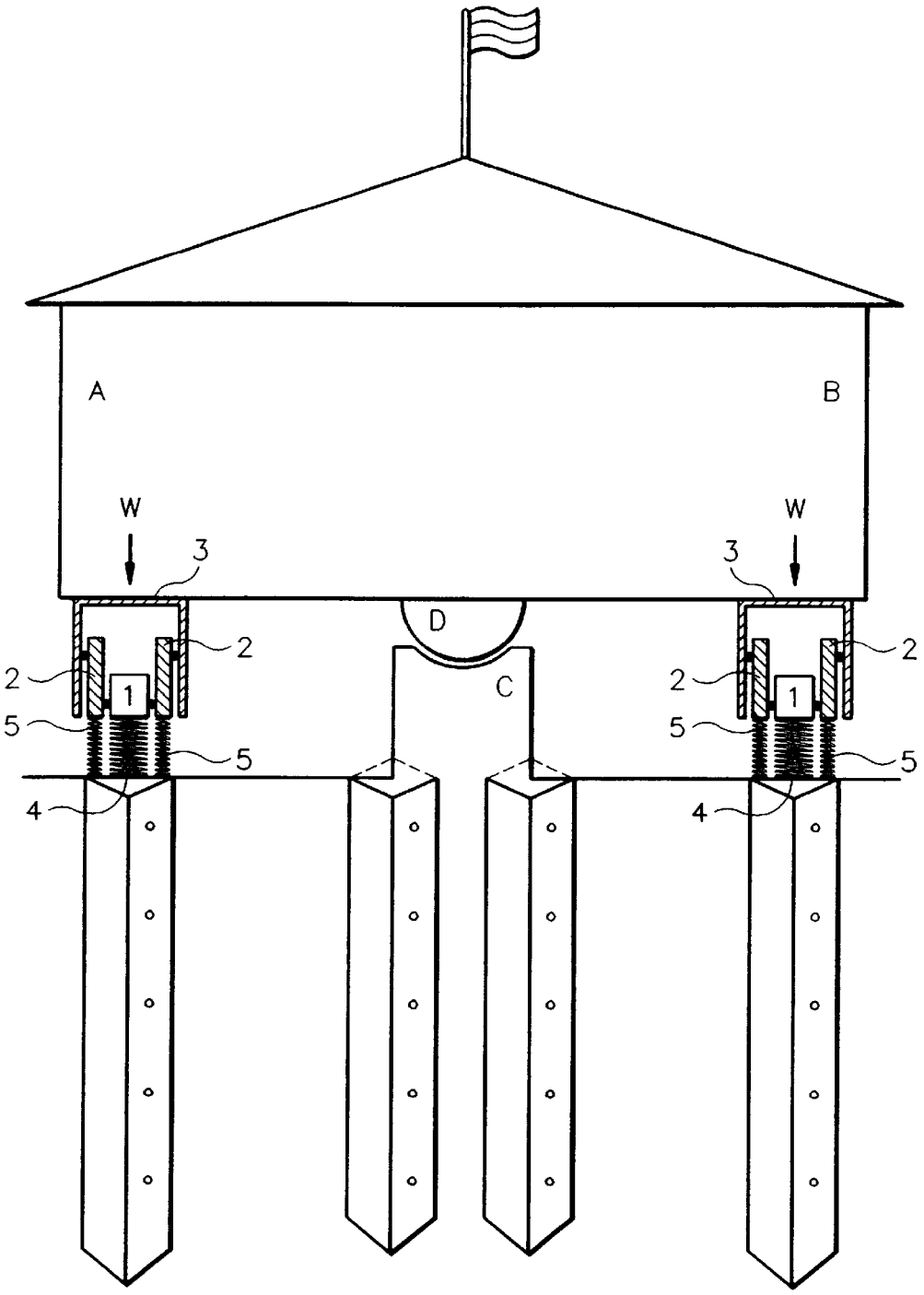
FIG. 5 is a schematic cross-sectional view showing a variation of the apparatus shown in FIG. 4.

FIG. 5 is the variation of the building shown in FIG. 4 whereas the load-bearing apparatus was replaced by the ones shown in FIG. 2.

It is to noted that the present invention is not limited to the above description of illustrative embodiments. For example, the present invention may use other types of spring in place of a coil spring, and that the location of the major and minor pontoons or hydraulic cylinders, or the higher and lower compression capacity springs are interchangeable.

I claim:

1. A method for the improvement of load-bearing capacity of floating structure, including the diversion of loads to other area(s) of the structure by means of hydraulic action between at least two floating or resilient means installed under the floating structure, said method comprising:

causing a first portion of a load at a first location in the structure to be imposed on a first of said means through a fluid in a first chamber associated with the first of said means, in response to the load, causing a portion of the fluid to flow from the first chamber through a confined passage to a second chamber associated with a second of said means at another location in the structure, and utilizing said flow to divert a second portion of the load to and cause downward movement of the second of said means, whereby the diversion of initial and subsequent loads is carried out in a predetermined manner.

2. A method as claimed in claim 1 wherein the floating means are pontoons or the like.

3. A method as claimed in claim 1 wherein the diversion of the initial load is carried out in full or partially.

4. A method as claimed in claim 1 wherein the resilient means are springs or the like.

5. An apparatus for the improvement of load-bearing capacity of floating structure comprising two or more hydraulically linked floating or resilient means of different buoyancies or compression capacities installed under the floating structure, wherein the floating or resilient means with the lower capacity has a precedence to take on the load over that of the floating or resilient means with the higher capacity.

6. An apparatus as claimed in claim 5 wherein the floating or resilient means are located apart from each other.

7. An apparatus as claimed in claim 5 wherein the floating or resilient means are located concentrically.

8. An apparatus as claimed in claim 5 wherein the load-bearing capacity of the lower capacity floating or resilient means is less than that of the higher capacity floating or resilient means.

9. An apparatus as claimed in claims 5 or 8 wherein the lower capacity floating or resilient means will take on the load until the design capacity is reached.

10. An apparatus as claimed in claims 5 or 8 wherein the higher capacity floating or resilient means will take on the load above the design capacity of the lower capacity floating or resilient means.

11. An apparatus as claimed in claim 5 wherein the floating means are pontoons or the like.

12. An apparatus as claimed in claim 5 wherein the resilient means are springs or the like.

* * * * *